US008595899B2

(12) United States Patent
McRoskey et al.

(10) Patent No.: US 8,595,899 B2
(45) Date of Patent: Dec. 3, 2013

(54) DOOR JAMB INJURY PROTECTOR

(75) Inventors: Peter K. McRoskey, Encinitas, CA (US); Daniel A. McRoskey, San Diego, CA (US); John W. McRoskey, Rancho Santa Fe, CA (US)

(73) Assignee: Carlsbad Safety Products, LLC, Carlsbad, CA (US)

( * ) Notice: Subject to any disclaimer, the term of this patent is extended or adjusted under 35 U.S.C. 154(b) by 0 days.

(21) Appl. No.: 13/252,091

(22) Filed: Oct. 3, 2011

(65) Prior Publication Data

US 2012/0079680 A1 Apr. 5, 2012

Related U.S. Application Data

(60) Provisional application No. 61/389,147, filed on Oct. 1, 2010.

(51) Int. Cl.
*E05F 5/04* (2006.01)

(52) U.S. Cl.
USPC ..... 16/83; 16/82; 16/86 R

(58) Field of Classification Search
USPC ..... 16/82, 86 R, 86 B; 292/288, 343, 292/DIG. 15, 251.5, DIG. 19
See application file for complete search history.

(56) References Cited

U.S. PATENT DOCUMENTS

| | | | | | |
|---|---|---|---|---|---|
| 1,037,641 | A * | 9/1912 | Koch, Jr. | ..... | 16/83 |
| 2,150,435 | A * | 3/1939 | Floreth | ..... | 16/76 |
| 3,800,360 | A * | 4/1974 | Knarreborg | ..... | 16/83 |
| 4,368,555 | A * | 1/1983 | Salerno | ..... | 16/83 |
| 4,982,474 | A * | 1/1991 | Kjellstrom | ..... | 16/82 |
| 6,003,911 | A * | 12/1999 | Sowash | ..... | 292/343 |
| 6,550,186 | B2 * | 4/2003 | Haq | ..... | 49/383 |
| 2010/0050377 | A1 * | 3/2010 | Ritachka | ..... | 16/83 |

FOREIGN PATENT DOCUMENTS

GB 2213519 A * 8/1989

* cited by examiner

*Primary Examiner* — Chuck Mah
(74) *Attorney, Agent, or Firm* — EIP US LLP

(57) ABSTRACT

A door safety device for either a hinged or a sliding door which when closing places the vertical door side edge in a position abutting the vertical face of either of two sides of a door jamb, or the vertical face of another sliding door, or the threshold end of a sliding door track. The device employs a body in pivotal engagement with a resilient body for positioning the body in an as-used position between the door side edge and the vertical face to maintain a gap to prevent finger crushing. A curved leading edge provides a deflection of impact forces upon the resilient body to prevent marring of the vertical face of the door jamb or threshold.

9 Claims, 9 Drawing Sheets

DOOR JAMB INJURY PROTECTOR

BACKGROUND OF THE INVENTION

1. Field of the Invention

This application claims priority to U.S. Provisional Application No. 61/389,147 filed on Oct. 1, 2010 and incorporated herein in its entirety by reference.

The present invention relates to safety devices. More particularly the disclosed device relates to door-engageable guards for preventing injuries such as those occurring when fingers are injured between a closing door and the jamb.

2. Prior Art

It is a sad fact of modern living that most children and even adults have at some point in their life injured a finger in the jamb of a closing door. For large and heavy doors, the closing door can become an almost unstoppable swinging lever arm with immense crushing power. These accidents can be extremely painful and can break bones and can actually sever fingers.

Conventional guards are known to help prevent fingers from entering the gap between the hinged edge of the door and the door jamb. However, efforts to date to prevent the crushing of fingers positioned between the door on the latch side, and the jamb have been less than successful. Often, if in a hurry, one will close a door by simply grabbing the edge of the door and swinging it closed behind them as they pass through. This inattention to a common task greatly increases the chance of a finger getting caught between the closing door and the jamb. Similarly, for sliding doors with no knob present, one may similarly grab the edge of the door and slide the door into the closed position with fingers directly in the path of the crushing force of the sliding door.

As such, there is a continuing unmet need for a cost effective and easily engaged device that provides protection for fingers positioned between the jamb and the latch side of closing doors. Such a device should be easily mounted and if disengageable, should preferably default to a protective position.

SUMMARY OF THE INVENTION

The device and method herein disclosed and described achieves the above-mentioned goals through the provision of a resilient member component that is adapted to absorb and dissipate the force of a door impacting the jamb when mounted to a closing door where one of two side edges of the door, is approaching a vertical face of a door jamb, sliding door frame, or another sliding door. Preferred materials include, but are not limited to, a group of compressible materials including one or a combination of polyethylene, polyurethane, polypropylene or the like. The resilient member is of desired durometer to withstand the force of a closing door. Currently a desirable durometer is between 30*a*-75*d* with a particularly favored range of 45*a* to 55*d*.

The resilient member is pivotally engaged to a base component by a rotational engagement means such as a hinge. The base component is adapted for engagement at or near a door's edge, for example by means of adhesive or screws.

In one preferred embodiment, the hinge or rotational engagement means is located substantially centered on the base component. This affords the resilient member the ability to be adjusted from an as-used position where the resilient member is extended over the edge of the door at a distance greater than the thickness of a human finger, to a stored position. Preferably the resilient member is biased into the as-used position by a biasing means such as a spring, or held by a positioning means such as hook and loop fasteners. In a biased positioning the hinge or similar pivotal engagement means may be spring loaded to bias the resilient member to this as-used position, making it the default position. This is preferred since as a safety device in most instances the preferable position is to protect users. In the as-used position, as the door approaches the closed position and the resilient member is positioned proximate to the jamb, the resilient member impedes the doors edge from translating past the door jamb thereby providing a means for preventing anything in-between, such as fingers, from getting crushed.

Should closure of the door be desired such as in the evening when it is to be locked, the resilient member is positionable to a stored position. Movement to the stored position is provided by a rotation of the resilient member on a hinge mechanism which allows the resilient member to rotate considerably away from the door's edge. This position allows the door to close as usual.

Should the resilient member be biased toward the as-used position, a means to hold the resilient member in the stored position may be provided such as hook and loop type fasteners or some frictional biasing means of engagement. Removal from the stored position is thereafter a simple exercise by user action of pushing upon the resilient member to disengage the hook and loop fabric (or to overcome frictional biasing) and thereby allow a rotation to the as-used position. Of course the resilient member can also be provided without the biasing toward the as-used position if desired.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device in the protection fingers and the like from closing doors. It is important, therefore, that the claims be regarded as including such equivalent construction and methodology insofar as they do not depart from the spirit and scope of the present invention.

It is an object of this invention to provide a means to prevent fingers from being crushed in the latch side, or hinge side, of a closing door through the provision of a pliable spacing component.

It is another object of this invention to provide a means to position the resilient member from an as-used position preventing full door-closure, to a stored position allowing closure, thereby encouraging use on doors where closure might be required periodically.

It is yet another object of the current invention to encourage use by the provision of a removable means of engagement such as adhesive or a peel and stick mounting component to minimize concerns regarding marring.

It is yet another object to provide a pinch prevention device which may be employed both upon a hinged door and a sliding door, and on other closing components such as sliding drawers or cupboards to prevent pinching of fingers.

It is yet another object of the invention, to provide such a pinch protection component which also has a shock-absorption ability to help prevent door and jamb dings and potential hinge damage from slammed doors.

It is yet a further object of the invention, to provide such shock-absorption which also protects the mount of the device to the door and a stress or force disconnection thereof.

These together with other objects and advantages which become subsequently apparent reside in the details of the door pinching protection device and method herein as more fully hereinafter described and claimed, reference being had to the accompanying drawings forming a part thereof, wherein like numerals refer to like parts throughout.

BRIEF DESCRIPTION OF DRAWING FIGURES

Figure 15:
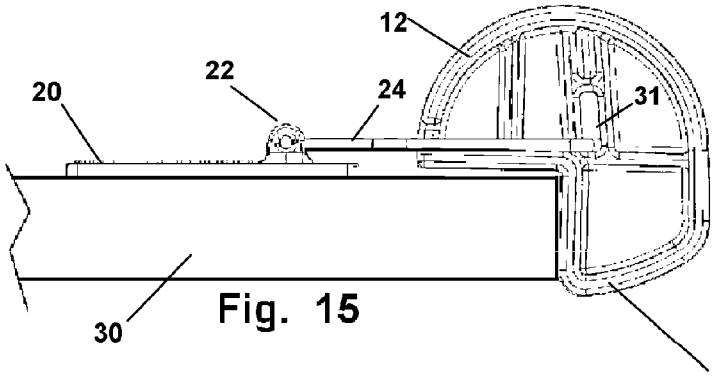
FIG. 15 depicts the device of FIG. 12 rotated on the pivot to the as-used position having a curved leading edge transitioning to a planar edge and back to a curved edge.
Figure 17:
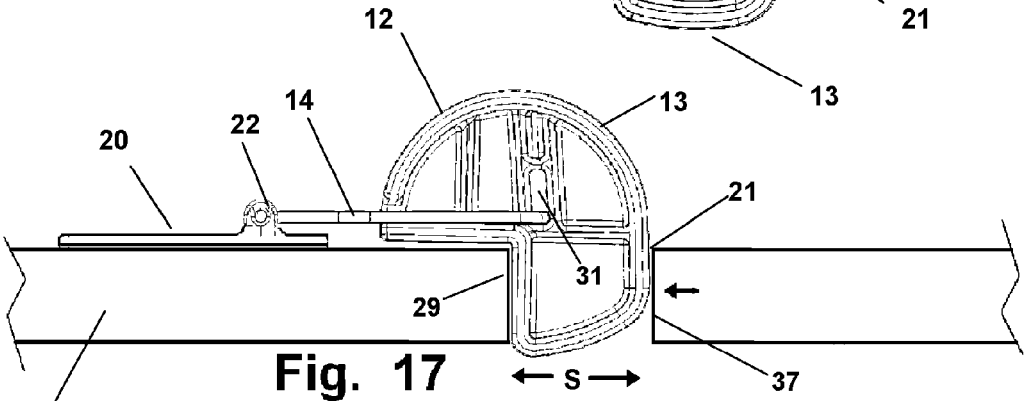
FIG. 17 depicts the device of FIG. 15, employed on a sliding door to maintain a space between the sliding door and a mating surface to the leading edge of the sliding door.
Figure 17A:
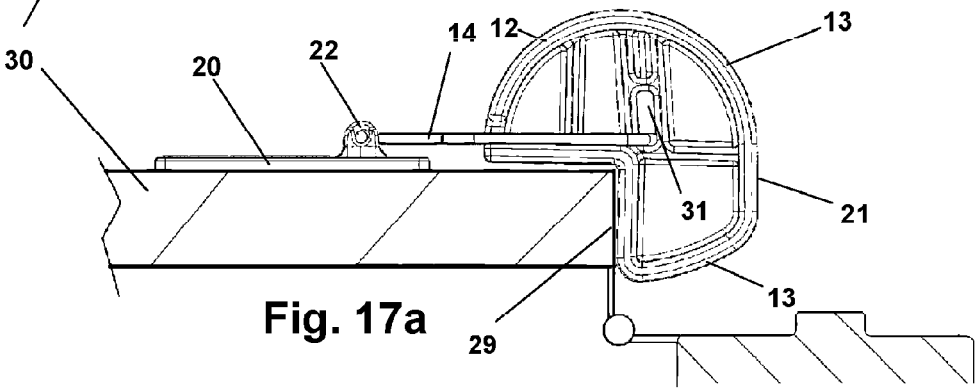

FIG. 17*a* depicts the device of FIG. 15 positioned for use on the hinge side of the door.

Figure 18:
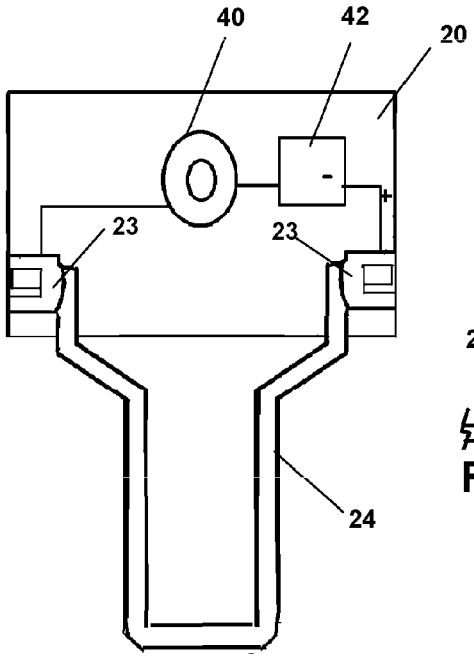

FIG. 18 depicts an alarm activated by a closure of a door upon the device in the as-used position.

Figure 18B:
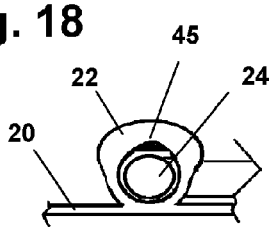

FIG. 18*b* depicts one mode of a switching means to complete the circuit for the alarm of FIG. 18 upon a compression of the resilient member between the door and a jamb or mating surface.

Figure 19A:
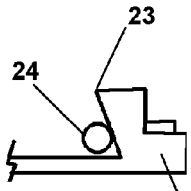
Figure 19:
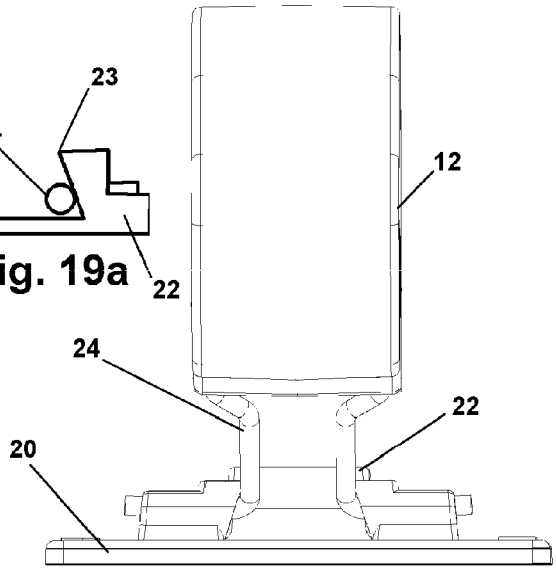

FIG. 19 depicts the mount-provided means to bias the support arm member, and attached resilient member toward one of the as-used or stored positions.

FIG. 19*a* is an enlargement of the slanted inner surface of the rotational support arm mount showing a tipping point between a bias toward the as-used or stored position for the support arm.

Figure 20:
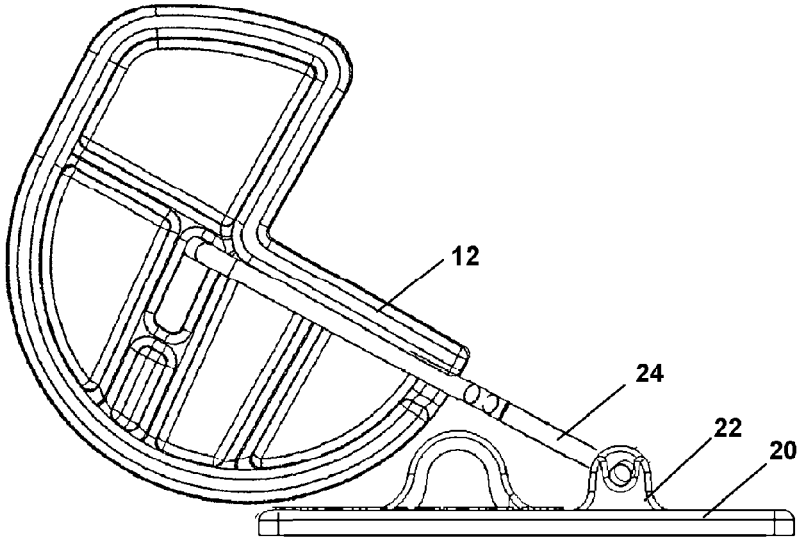

FIG. 20 shows the device in the retracted position pivoted away from the leading edge and removably held adjacent to the base by one or a combination of releasable fasteners and a biasing means.

Figure 21:
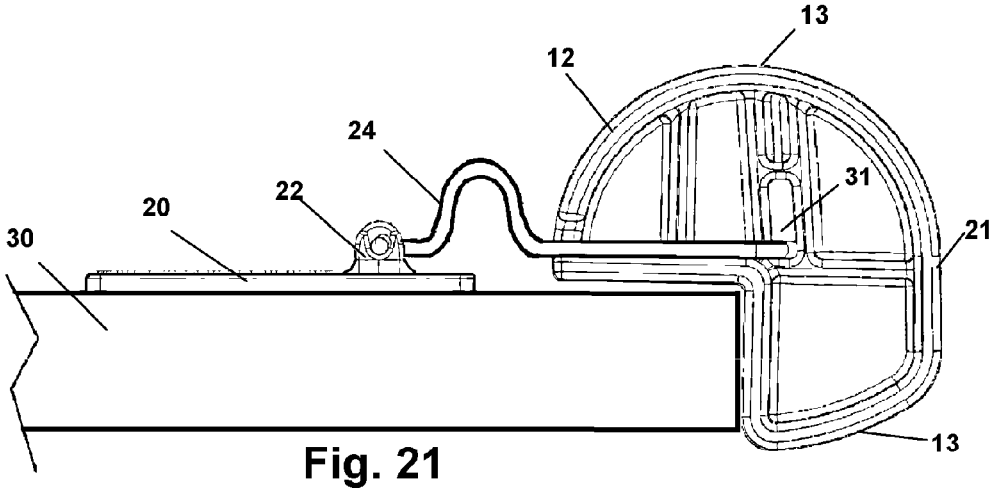

FIG. 21 depicts the device having a curved support arm providing a means for shock absorbing forces communicated down the support arm toward the pivot mount which may be employed alone or in combination with other mounts.

DETAILED DESCRIPTION OF THE PREFERRED EMBODIMENTS OF THE INVENTION

Figure 1:
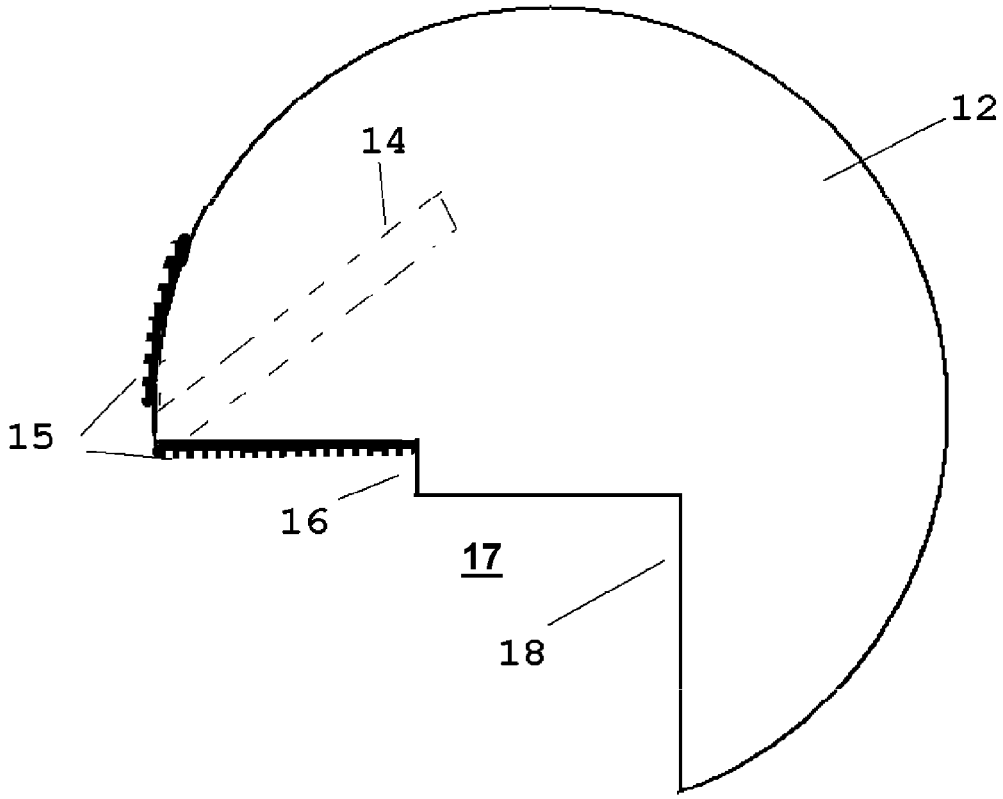
FIG. 1 shows a top view of one embodiment of the resilient member of the device depicted in a preferred shape with a curved circumferential leading surface.

Referring now to the drawings of FIGS. 1-11, there is seen in FIG. 1 a top view of one preferred mode of the resilient member 12. This mode employs a resilient member 12 having a curved surface 13 upon a leading edge side opposite a mounting surface area 17 having a base component inset 16, and door-edge contact surface provided by the two substantially perpendicular walls of an inset 18. A receiving cavity 14 for the pivoting member 24 is shown in dotted line as it is formed within the body of the resilient member 12.

Figure 2:
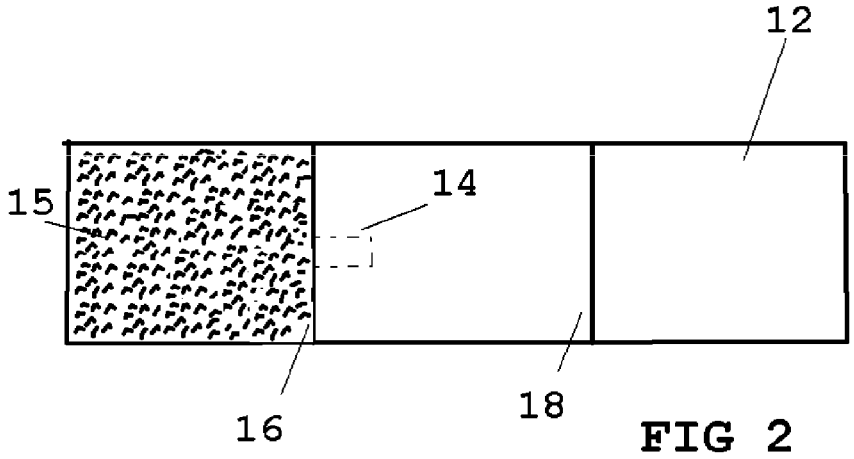
FIG. 2 shows a side view of the embodiment of the resilient member as depicted in FIG. 1 showing the relative thickness as well as placement of the hook and loop type fastener material which is employable to maintain the position thereof.

FIG. 2 shows a side view of this mode of the resilient member 12 from the mounting surface area 17. Shown are stepped surfaces as well as placement of the cooperative releasable fastener 15 provided by the hook and loop material on the first step which is adjacent to the two perpendicular surfaces forming the inset 18 to engage against the leading vertical side edge of a rotating or sliding closure, such as a door 30 (FIG. 5) or drawer.

Figure 3:
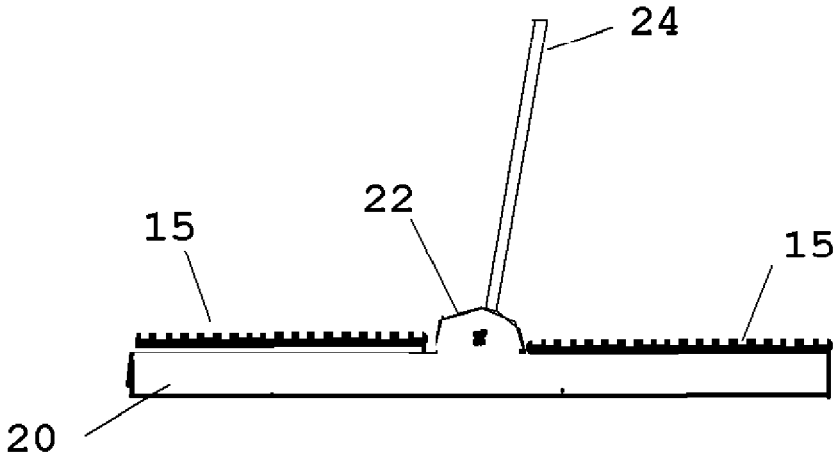
FIG. 3 shows a side view of the one embodiment of the base component and pivot mechanism and also displaying the hook and loop type fasteners.

As can be seen in FIG. 3, which is a side view of one preferred mode of the base component 20 is configured to pivot the resilient member between the as-used position of FIGS. 5 and 15-17 in the space between the sided edge of the door 30 and an abutting vertical face, and the retracted position of FIG. 20 which is typical of all modes of the device 10. A pivoting action is provided by rotational engagement 22 at a first end of the support arm 24 which is opposite the distal end of the support arm 24 operatively engaged with a central area of the resilient member 12. A rotation of the support arm 24 to either position will cause it to maintain that position, again either by a biasing force against the support arm 24 or a releasable fastener, or both if desired.

Figure 4:
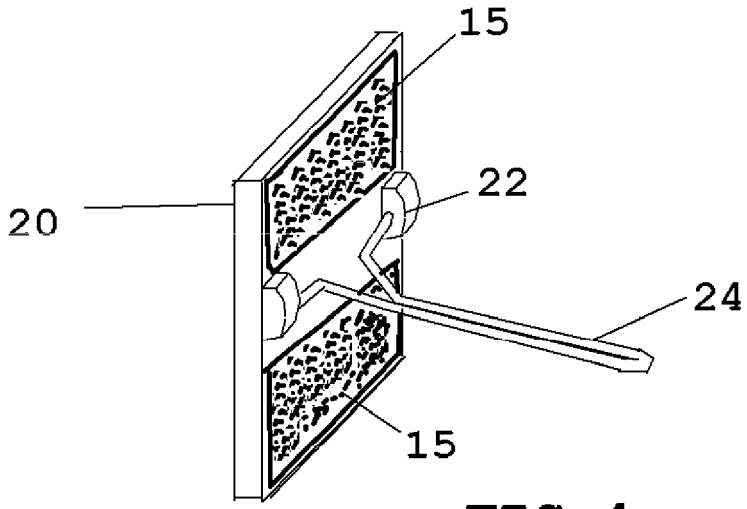
FIG. 4 depicts an isometric view of the base component and pivot mechanism.

A perspective view of the base component 20 is seen in FIG. 4 which illustrates the means for pivoting provided by the base component 20 having the rotational engagement 22 of both proximal or first ends of the support arm 24 with a complimentary rotational aperture. Means of engagement of the resilient member 12 to the rotational engagement 22 is provided by the support arm 24 which is bent or curved at both proximal or first ends, each of which engages cooperatively with the receiving cavity 14 of the resilient member 12. Of course other rotational means of engagement may be employed as would occur to those skilled in the art.

Figure 5:
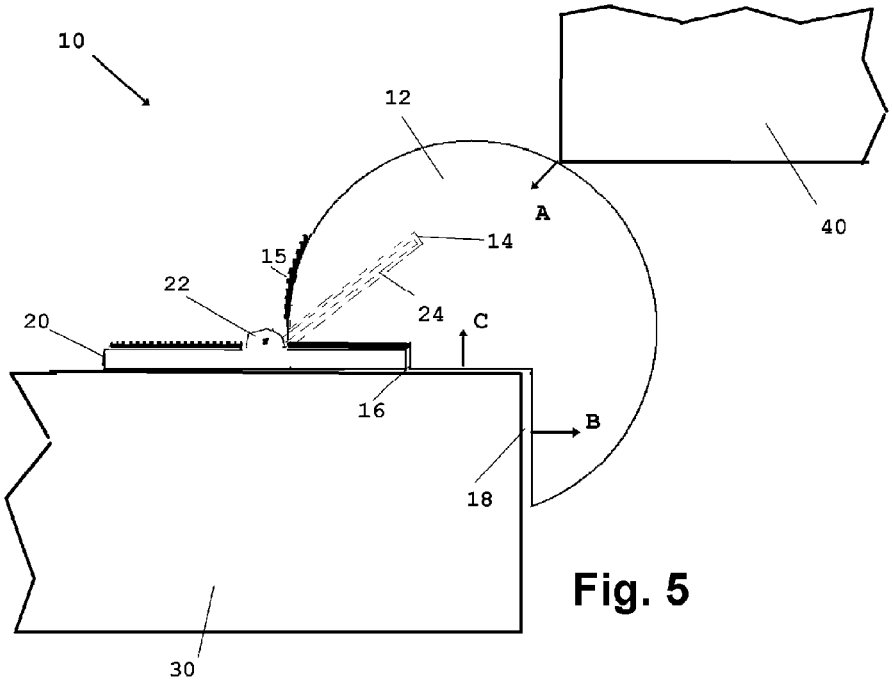
FIG. 5 shows a top view of the curved resilient member moved to an as-used position engaged over the leading edge of a door and impacting a door jamb on the curved edge.

As seen in FIG. 5, the base component 20 is engageable to the door 30, or other surface, by a removable means of engagement such as adhesive or hook and loop fabric both of which have stretchable qualities allowing a slight translation under high stress, which is preferable. However some may wish to use screws and fasteners and any such fastener as would occur to those skilled in the art are anticipated within the scope of means of attachment herein. As screws and such fasteners are commonly known, they need not be pictured however any screw or fasteners adapted for engagement of the device herein as is available in the GRAINGER catalog of 2011 made part hereof, is considered within the scope of this application.

The removable means of attachment employed currently is adhesive between the base component 20 and the door 30. Currently a peel and stick two-sided tape is employed but other adhesive means may be employed. Hook and loop fabric may also be employed to hold the base component 20 to the door 30. As noted, adhesive or hook and loop are preferred as they provide a margin of "give" should the force on the resilient member 12 be sufficient to communicate along the arm 24 to the base component 20 and this provides means for slight lateral translation as a shock absorber against excessive force.

If no means for biasing is employed at the first ends of the resilient member 12, it may be held in the as-used position, or the retracted position (FIG. 20) using hook and loop type fastener 15 upon the resilient member 12 and co-operating hook and loop fastener 15 operatively positioned on the base component 20.

In the mode of the device 10 of FIG. 5, there is also shown a relief or first inset 16 or notch, which accommodates the width of the base component 20 and provides a means for a flush surface contact for the resilient member 12 against the door 30, when in the as-used position. The inset 18 as noted in FIG. 1, is formed of two adjacent perpendicular surfaces next to the first inset 16, provides for a dual surface contact over the leading edge of the door 30.

Upon an impact between the resilient member 12 so mounted, force vector "A" is directed into the resilient member 12 by a compression between the vertical side edge or leading edge 29 of the door 30, and the vertical face of another sliding door or sliding door track threshold depicted as jamb 40. This force is dampened by the compression of the resilient member 12 which is formed of compressible material such as polyethylene, nylon, or polyethylene, or the like. The compression does work and dissipates some of the force before being absorbed into the door 30 by force vectors B and C as depicted. Because the force vector "A" is perpendicular to the tangent at the point of contact with the curved surface of the resilient member 12, a slight rotational force may also be imparted and absorbed by the resilient member 12.

Figure 6:
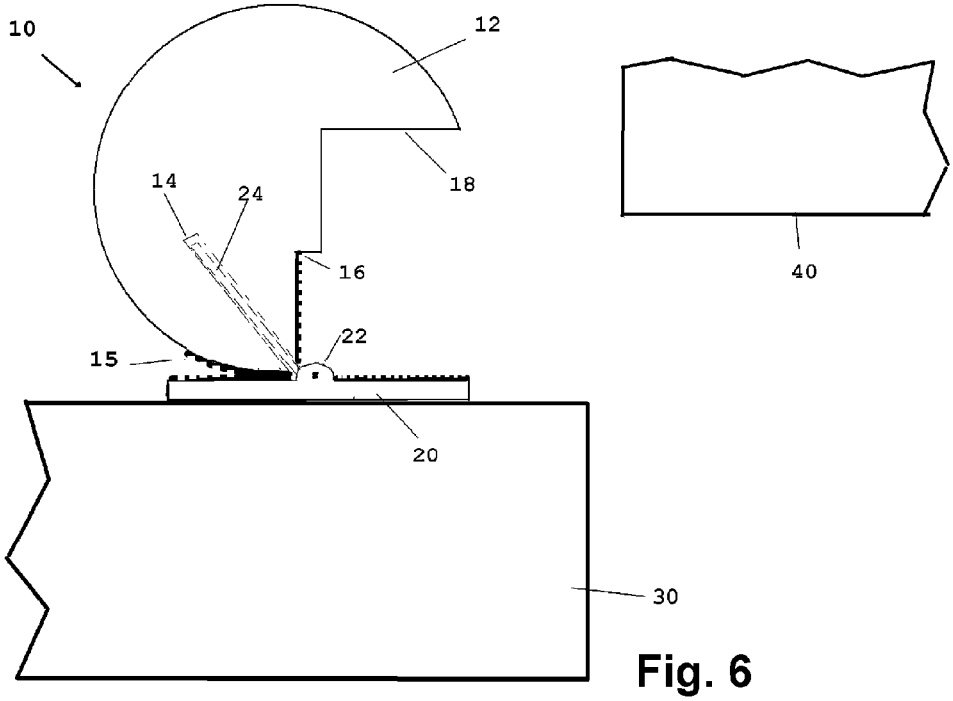
FIG. 6 depicts a stored position of a first mode of the device, wherein the member is pivoted out of the gap between the door and jamb.

Seen in FIGS. 6 and 20, a user may achieve the stored or retracted position of the resilient member 12, by a simple rotation of the resilient member 12 about the rotational engagement 22 as shown. This stored or retracted position can be maintained by means of hook and loop type fasteners 15 or other releasable fasteners, or as noted by a biasing of the support arm 24 at the first ends thereof as shown in FIG. 19*a*. This stored position allows clearance for the door 30 and jamb 40, or the door 30 and a wall or second sliding door, so closure is possible.

Figure 7:
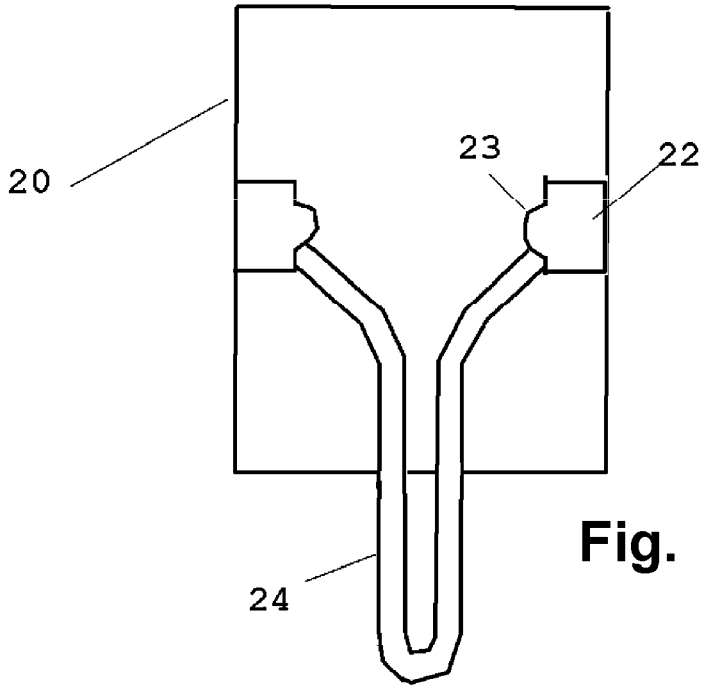
FIG. 7 shows a top plan view of a mode of the pivoting mechanism depicting a frictional biasing component configured to maintain the support member and resilient member in either the as-used or retracted positions.

FIG. 7 shows a particularly preferred mode of the base component 20, having the rotational engagement 22 for the support arm 24. This mode does not require the use of hook and loop type fasteners 15 to maintain the support arm 24 in the previously described stored and as-used modes. Static positioning with a continued biasing force in either direction, is achieved via friction tabs 23 positioned to impart force to the first ends of the support arm 24 adjacent to the rotational engagement 22. The tabs 23 formed by an angled inner surface of the rotational engagement 22 impart a force to maintain the arm 24 in either the as-used or stored positions. Changing between the positions require user action to rotate the support arm 24 from one position to the other, and past a tipping point in the tabs 23 which is the narrowest separation between the two rotational engagements. Once past this tipping point, the support arm 24 is continually biased to stay in its respective position.

Figure 8:
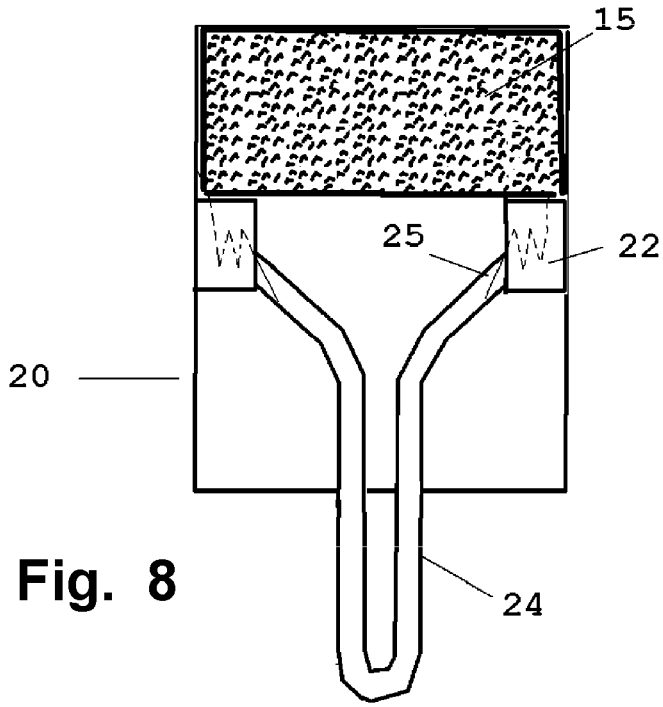
FIG. 8 shows a preferred embodiment of the hinge and base components depicting a spring loaded pivoting component wherein a biasing spring engages the support arm or member and provides a biasing toward the as-used position or a hook and loop type fastener to the stored position.

Another mode of biased rotational engagement is shown as base component 20, rotational engagement 22, and support arm 24 is seen in FIG. 8. This mode incorporates a biasing spring 25 exerting a biasing force to the engaged first ends of the support arm, toward the as-used position. The stored position is achieved using a connector such as hook and loop type fastener 15 sufficient to overcome the biasing force and maintain the resilient member 12 in the stored position. Again, once disengaged from the stored position, the support arm 24 and resilient member 12 may be biased toward or may be rotated to the as-used position if no biasing means is engaged, or will self-rotate to the as-used position if a biasing force is engaged.

Figure 9:
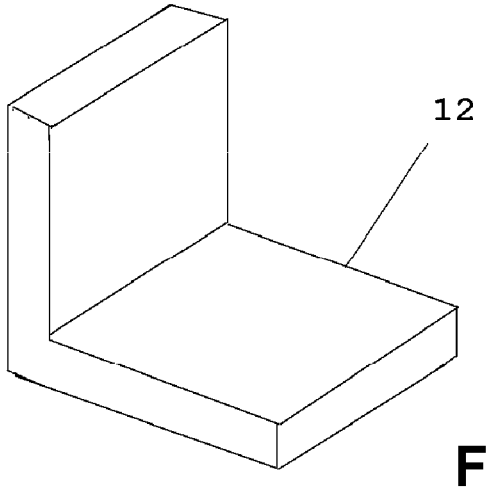
FIG. 9 shows another mode of the resilient member of the device formed as a right angle resilient member in a pivoting engagement with the door.
Figure 10:
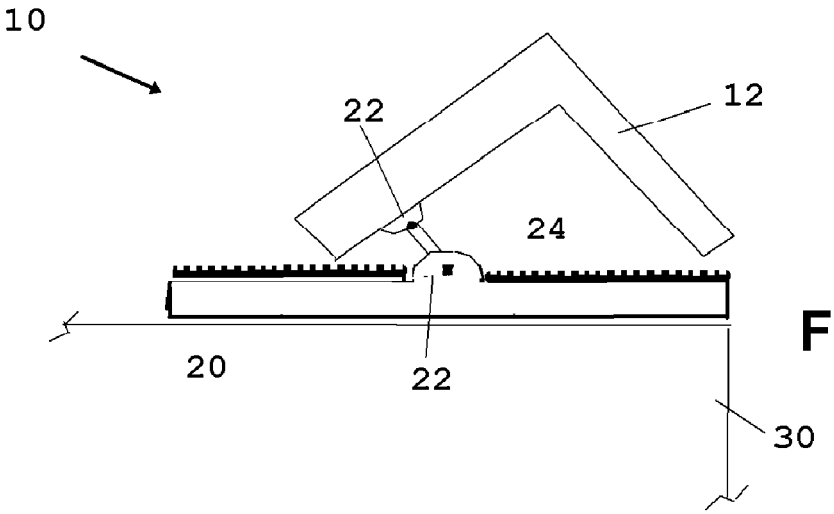
FIG. 10 depicts the stored position of the device moved by a pivoting system with the embodiment of the resilient member as described in FIG. 9.
Figure 11:
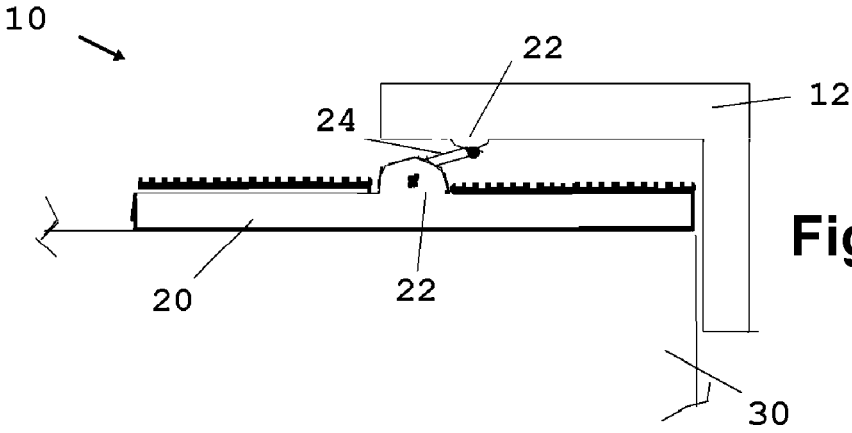
FIG. 11 shows the member pivoted to the as-used position.

An additional mode of the resilient member 12 is seen in FIG. 9. This mode employs a substantially angled member with appreciable thickness. This mode of the device achieves the above mentioned as-used and stored positions through the provision of a dual hinge mechanism defined by rotational engagements 22 on both ends of the support arm 24 as depicted in FIGS. 10 and 11. While the curved mode of the resilient member 12 is preferred since it is adapted to deflect and absorb more impact forces, this angled mode of the resilient member 12 might also be employed to provide impact protection during door closure.

FIGS. 12-13 and 15-16 depict another preferred mode of the device 10 wherein the resilient member 12 has a substantially curved surface 13 surrounding a substantially planar surface area 21. This mode of the device 10 is configured to be employed in both door jambs as in FIG. 16, as well as with sliding doors 30 as in FIG. 17 such as with patio doors and/or pocket doors.

As can be seen in FIGS. 12-16, the resilient member 12 is engaged to the rotating support arm 24 in a rotational engagement 22 at the base component 20. The preferred mode for biasing to either of the two positions is provided by the frictional tabs 23 imparting force to the ends of the support arm 24 as disclosed above.

Figure 13:
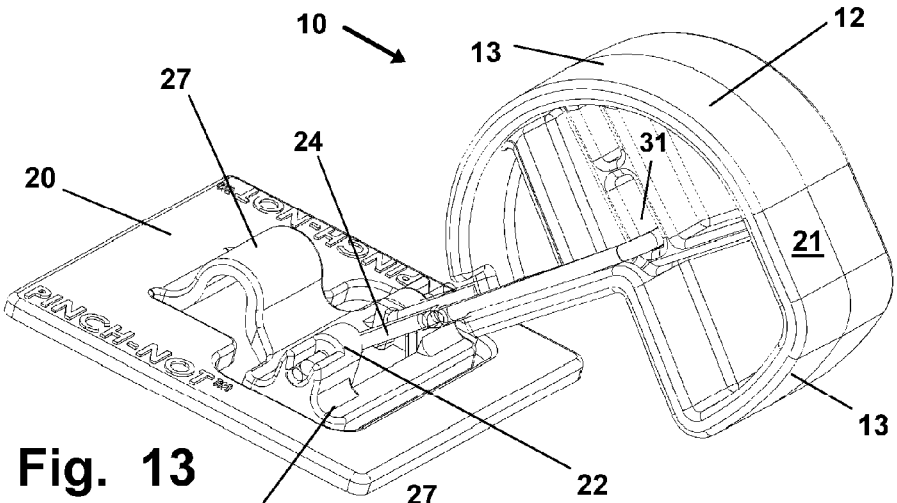
FIG. 13 depicts the device with the same resilient member as FIG. 12, but additionally including a shock absorbing pivot mount.
Figure 14:
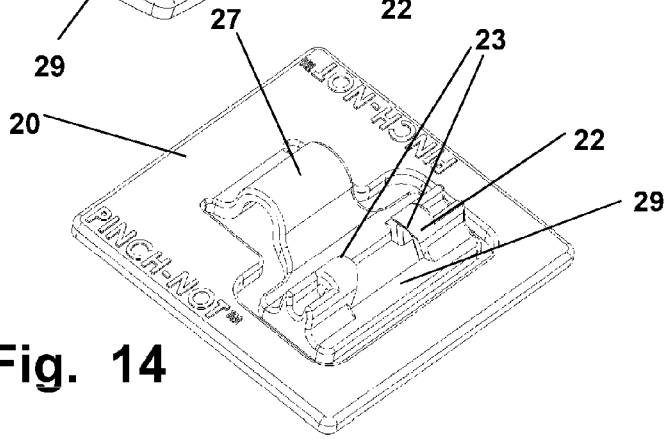
FIG. 14 is an overhead perspective view of the shock absorbing pivot mount showing the support arm rotational engagement formed on a leaf spring component.

FIG. 13-14 shows a mode of the device 10 with the same resilient member 12 but additionally including a shock-absorbing base component 20. This mode of the base component 20 may be employed with any mode of the device 10 herein. Means to dampen any force imparted from the resilient member 12 along the support arm 24 to the base component 20 is provided by a U-shaped flexible member 27 engaging the free floating portion 29 of the base component 20. Force imparted to the rotational engagements 22 will cause a flex of the flexible member 27 and movement of the floating portion 29 and protect the engagement at the rotational engagements from breaking due to excessive force.

Figure 12:
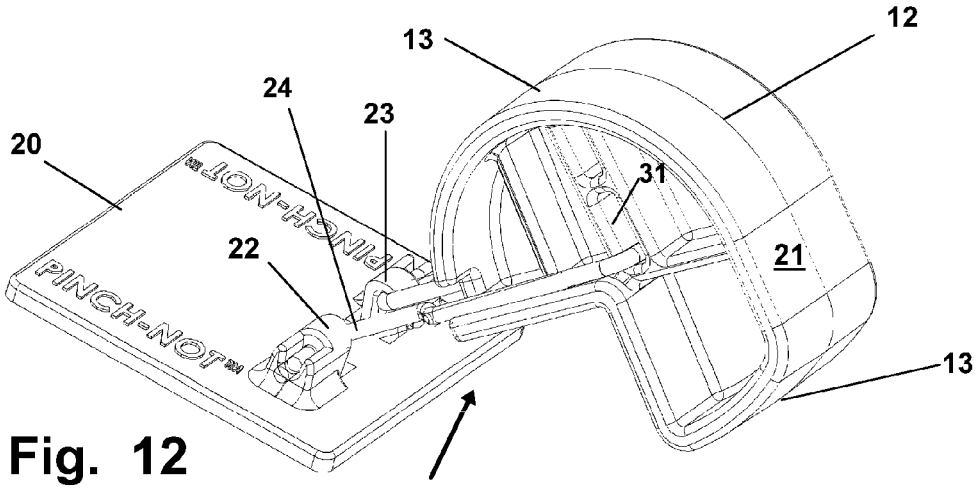
FIG. 12 depicts another preferred mode of the device wherein the resilient member has a substantially planar surface area interspersed between sections of curved exterior surface.
Figure 16:
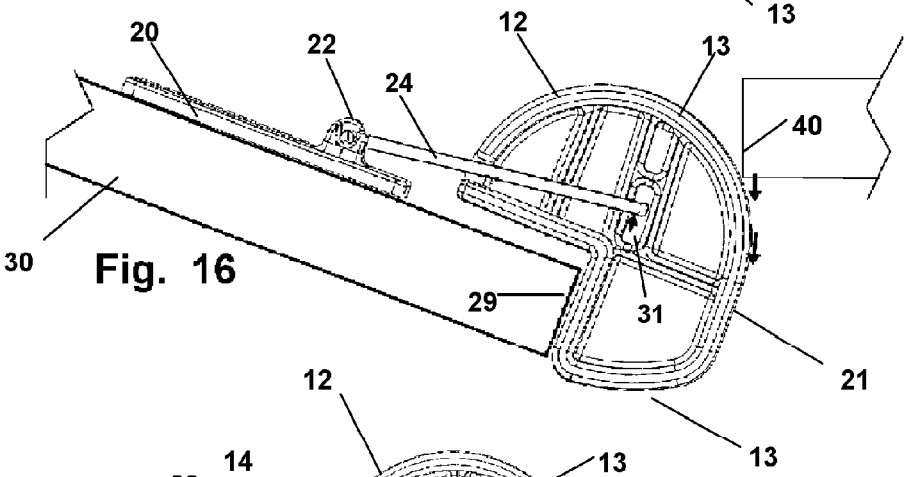
FIG. 16 depicts the device as in FIG. 15, engaged and slightly compressed between the leading edge of the door on which it is engaged, and the leading corner of the door jamb.

FIG. 15 depicts the device of FIG. 12 or 13, rotated on the base component 20 to the as-used position. In this position the curved leading edge is positioned for impact and compression between the door jamb 40 edge, and the leading edge 29 of the door 30. As seen in FIG. 16, additional means for damping force imparted to the base component 20 and support arm 24 to prevent damage is provided by a means to allow a slight rotation of the resilient member 12 upon its engagement with the support arm 24.

As can be seen in FIG. 15, the device in the as-used and ready position, engages the support arm 24 to the resilient member 12 in an elongated slot 31. Prior to impact shown in FIG. 16, the engagement occurs at a lower end of the slot 31. However, upon engagement between the door 30 and jamb, as in FIG. 16, the compression of the resilient member 12 material, and angle of force, imparts a slight rotation to the resilient member 12. This allows for additional compression of the resilient member 12 in its contact with the door leading edge 29. The force from the rotation upon the engagement of the support arm 24 is dampened by the translation of the ends of the support arm 24 along the slot 31.

FIG. 17 depicts the device 10 of FIG. 15, employed on a sliding door 30 in the as-used position to maintain a space "S" between the sliding door 30 and a mating surface 37. The planar 21 portion of the edge of the resilient member 12 has been found to provide a superior dampening of the compressive force between the two edges. And, more importantly, the planar portion 21 of the edge of the resilient member 12 engages at a right angle with the mating surface, thereby avoiding the imposition of any torque on the resilient body which could cause it to inadvertently move out of the as-used position.

FIG. 18 depicts an alarm 40 powered by a battery 42 and activated by a closure of a door 30 upon the device 10 when in the as-used position and can be employed in all modes of the device 10 if desired. A means for switching the alarm to report or make sound is provided by a means for switching upon an impact. This impact force imparted to the support arm 24 along its axis causes it to move at the first ends engaged with the rotational engagement. In FIG. 18*b* there are shown contacts 45 positioned in a gap above the normally situated support arm 24 ends, are engaged only when such force is transmitted down the arm 24. The support arm 24 engaging both contacts 45, completes the circuit to sound the alarm 40. Of course other means to switch the alarm by completing the electrical circuit to cause it to report with a noise or light as would occur to those skilled in the art and are anticipated.

FIG. 19 depicts an end view of the base component 20 and the mount-provided means to bias the support arm 24 toward either the stored or as-used positions. The angled inner edge of the rotational engagement 22 allows the bent first ends of the support arm 24 to ride thereon. The support arm 24 is thus biased to one of the two positions unless the user hand-rotates the resilient member and arm, past the tipping point 23 as can be seen in FIG. 19*a*.

FIG. 20 shows the device 10 of FIGS. 12-17, in the retracted or stored position pivoted away from the leading edge of the door 30. It is removably held adjacent to the base component 20 by one or a combination of releasable fasteners, or the biasing provided by the aforementioned spring or angled inner surface of the rotational mount.

FIG. 21 depicts the device having a curved support arm 24 which will bend if lateral forces are transmitted down the support arm and thereby providing another means for shock absorbing or damping such forces communicated down the support arm 24 toward the rotational engagement 22 and pivot mount. This mode may be employed singularly, or if extra damning is desired may be employed in combination with any other depicted mode of the device 10 herein.

While all of the fundamental characteristics and features of the disclosed door safety device have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

Consequently, all such modifications and variations and substitutions are included within the scope of the invention as defined by the following claims.

What is claimed is:

1. A door safety device to prevent injury during a closing of a hinged or sliding door, said door safety device adapted to be positioned between one of two vertical side edges of said door and a vertical face located at one of two sides of a door jamb, or at a threshold end of sliding door track, or at a vertically disposed end of a second sliding door, said door safety device comprising:

a body formed of resilient material;

a base member having an attachment surface configured to be attached to an attachment surface of the door; and means for pivoting said body between an as-used position where said body is located in a space between said vertical side edge of said door and said vertical face, and a stored-position where said body is located away from said space, the pivoting means having a proximal end and a distal end;

said body being movably attached to said distal end of said pivoting means and having a substantially planar edge portion configured to contact said side edge of said door when the body is in said as-used position, said body being configured to contact said vertical face during an attempted closure of said door and maintain said side edge of said door a distance away from said vertical face so as to prevent a crushing of a finger positioned between said side edge and said vertical face, at least when the body is in the as-used position;

wherein the body is movable with respect to the distal end of the pivoting means in a direction generally normal to the attachment surface of the base member, at least when the body is in the as-used position.

2. The door safety device of claim 1, wherein said body has a curved exterior surface portion, substantially opposite said planar edge, said curved exterior surface portion configured to contact said vertical face during movement of said side edge toward said vertical face, at least when the body is in the as-used position.

3. The door safety device of claim 2, wherein said body additionally comprising:

a planar surface portion substantially parallel to and facing a direction opposite from the substantially planar edge portion.

4. The door safety device of claim 1, wherein said means for pivoting comprises a pivot member, the pivot member being operatively coupled at its proximal end to the base member and operatively coupled at its distal end to a central portion of the body.

5. The door safety device of claim 1, wherein the proximal end of the pivoting means is movable with respect to the base member, in a direction generally parallel with the attachment surface of the base member, at least when the body is in the as-used position.

6. The door safety device of claim 5, wherein the base comprises a flexible member, the proximal end of the pivoting means being coupled to the flexible member such that the proximal end is movable with respect to the base member in a direction generally parallel with the attachment surface of the base member.

7. The door safety device of claim 1, further comprising an adhesive configured to attach the base member to the attachment surface of the door.

8. The door safety device of claim 1 additionally comprising:

an alarm, said alarm having an electrical supply, said alarm being configured to generate one or a combination of an audio or light-based announcement; and means for electrical switching said alarm to connect said electrical supply to said alarm when the body contacts said vertical face during an attempted closure of the door.

9. The door safety device of claim 1, wherein the body comprises a slot, the distal end of the pivoting means being movable within the slot such that the body is movable with respect to the distal end of the pivoting means in a direction generally normal to the attachment surface of the base member, at least when the body is in an intermediate position between the stored-position and the as-used position.

* * * * *